US005138248A

United States Patent [19]

Vogt et al.

[11] Patent Number: 5,138,248

[45] Date of Patent: Aug. 11, 1992

[54] LOAD INDEPENDENT CURRENT FEEDING CIRCUIT

[75] Inventors: Reinhard Vogt, Darmstadt; Helmut Brock, Bad Vilbel; Wolfgang Freitag, Frankfurt, all of Fed. Rep. of Germany

[73] Assignee: Hartmann & Braun AG, Fed. Rep. of Germany

[21] Appl. No.: 614,617

[22] Filed: Nov. 15, 1990

[30] Foreign Application Priority Data

Nov. 20, 1989 [DE] Fed. Rep. of Germany ..... 3938460

[51] Int. Cl.[5] ..... G05F 1/565

[52] U.S. Cl. ..... 323/273; 323/275; 307/530

[58] Field of Search ..... 323/234, 273, 245, 280; 307/530

[56] References Cited

U.S. PATENT DOCUMENTS 3,546,564 12/1970 Denny .
3,735,240 5/1973 Davis et al. ..... 323/4
4,618,814 10/1986 Kato et al. ..... 323/280
4,933,625 1/1989 Hayakawa ..... 323/275

FOREIGN PATENT DOCUMENTS 0326968 8/1989 European Pat. Off. .
3715886 11/1988 Fed. Rep. of Germany .
3815979 11/1989 Fed. Rep. of Germany .

OTHER PUBLICATIONS

Horowitz and Hill, The Art of Electronics (2nd edition) (c) 1989, pp. 457–462.

*Primary Examiner*—Steven L. Stephan
*Assistant Examiner*—Emanuel Todd Voeltz
*Attorney, Agent, or Firm*—R. H. Siegemund

[57] ABSTRACT

A circuit having a load connected to ground, a measuring resistor connected in series with the load; a current source feeding current into the load and the resistor, a different amplifier having one output connected to one end of the resistor and having its output connected to a summing point which is an input from the current source, a reference voltage source having one end connected to the summing point, is improved by an impedance converter having its input circuit connected to another end of the resistor and its output connected to another input for the differential amplifier, the latter output being further connected to an opposite end of the reference voltage source thus serving as floating ground for the reference source and the differential amplifier.

2 Claims, 1 Drawing Sheet

LOAD INDEPENDENT CURRENT FEEDING CIRCUIT

BACKGROUND OF THE INVENTION

The present invention relates to a circuit for feeding current to a grounded user which current is load independent and represents a measuring value.

The East German patent 2,400,86 describes a circuit for feeding a load independent current into user, the current representing measuring value and including a feedback control amplifier with inputs representing desired and actual measuring value and further including a resistance passed through by the load independent current from which the desired value, subject to the control is taken and fed to the control amplifier. The central element of the circuit is the control amplifier comparing at one input voltages representing desired and actual value, and a load independent current is forced into a measuring resistor such that variations across the resistor are detectable as variations in the voltage drop.

A book by Tietze and Schenck, Springer-Verlag, 1971, under the title "Halbleiter-Schaltungstechnik", page 340 shows a similar circuit. The circuit includes a feedback control amplifier with a differential stage and a controllable current source. The control amplifier provides a current I which is on one hand load independent but is determined by a desired value voltage. The current from the source is passed through a user circuit. The circuit as such constitutes a feed back circuit wherein then the desired voltage taken from a current measuring resistor is used as feed back control variable. Users on the other hand which are grounded at one end have the problem that the desired voltage is superimposed upon a push or push or in phase signal that may vary over a wide range. In another book which is in effect updated issue of the aforementioned book but now referred to as Tietze-Schenck 1980 shows in pages 667–670 a discussion of the problem resulting from this push push signal and the problems resulting therefrom. The remedy proposed in that publication, is set forth in Section 2.5.1.2 and includes a separating amplifier which separates signal and ground connection between the transmitter and receiver and to provide a transmitter with a floating connection to ground.

DESCRIPTION OF THE INVENTION

It is an object of the present invention to provide a new and improved circuit of the kind referred to in the introduction such that the interferences in the feedback resulting from push push signals pulses produced by the user and affecting the control amplifier is minimized.

It is a specific object of the present invention to provide a new and improved circuit for feeding a grounded user and load circuit with a load independent current representing a measuring value, the circuit to include a control amplifier having as an input a desired value voltage and an actual value voltage which in turn is taken from a resistor and passed through by the aforementioned load independent current.

In accordance with the preferred embodiment of the present invention it is suggested to feed the voltage that develops between true ground and across the main load, to a high ohmic impedance converter and that the output of that impedance converter is used as a reference level for the control amplifier in general and for the desired signal value level in particular. Hence the invention is to be seen in avoiding the problem provided by push-push signals and a floating reference is used instead. The reference for the desired and reference voltage as it is effective in the control amplifier is simply subject to variations that correspond to the voltage drop across the main user. This way one obtains a virtual reference potential so that on the other hand the actual voltage that is taken from the measuring resistor remains free from push push signals. The floating current supply is realized through the voltage controller having as a reference potential the voltage that is taken from the user independently from the acquisition of the actual signal that is subject to the control.

DESCRIPTION OF THE DRAWINGS

Figure 1:
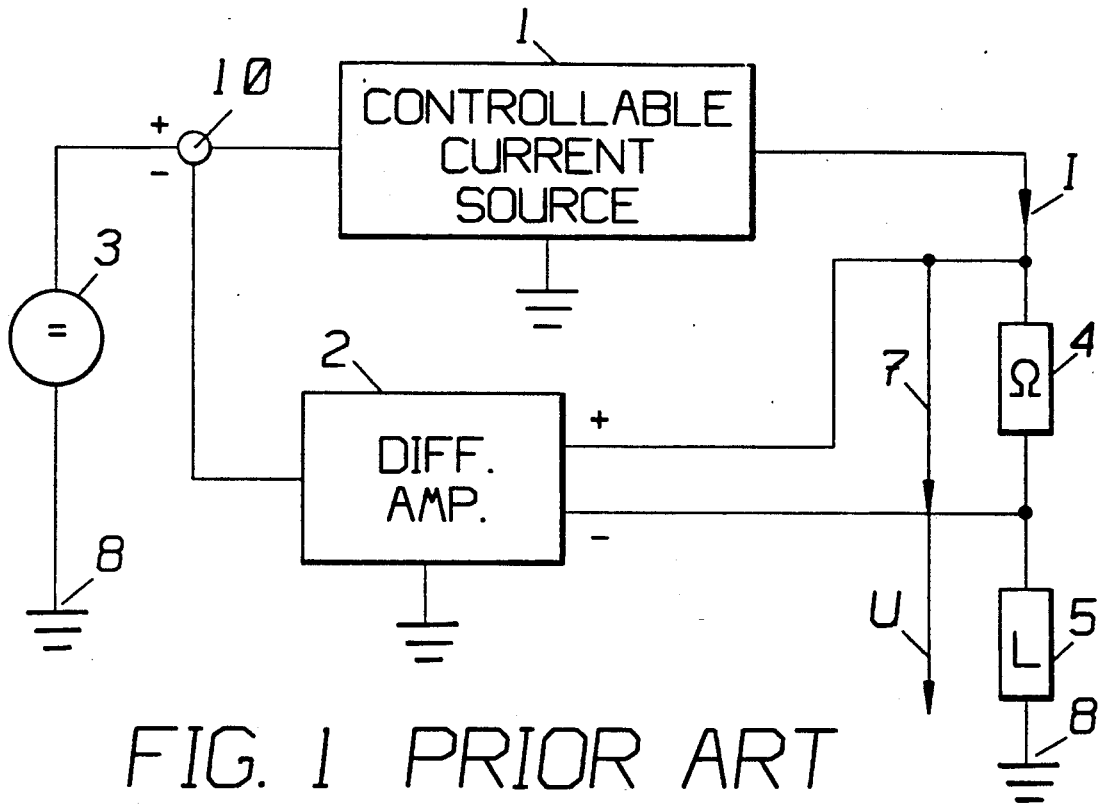
FIG. 1 PRIOR ART
FIG. 1 is a block diagram of a prior art current feeding circuit.

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 shows the prior art circuit which includes a control amplifier having as its main component a differential amplifier 2, and a controllable current source 1. The current source provides a current I through the load 5. The differential amplifier 2 receives as between its inverting and noninverting inputs a voltage 7 which is taken from a current measuring resistor 4 which in turn is also passed through by the load independent current I. The load 5 is grounded at 8. The problem exists that this voltage 7 will be superimposed upon a push push signal that can vary over a wide range. Reference numeral 3 refers to the source of a reference voltage and 10 is the summing point for comparing the differential amplifier output and the reference voltage. The summing point output controls the current source. The reference source uses also 8 as ground.

Figure 2:
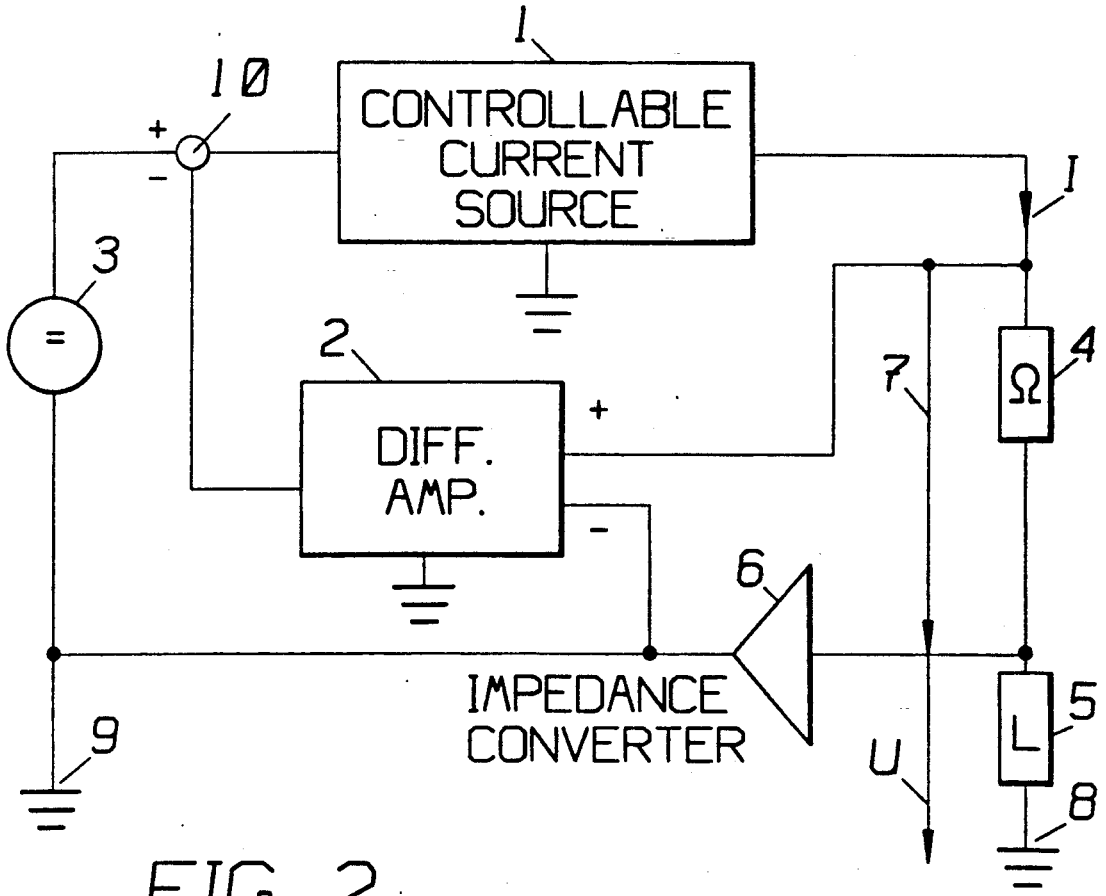
FIG. 2 is a block diagram showing a load independent current feeding circuit according to an embodiment of the present invention.

As per the invention most parts described thus far remain but the connections are different as is shown in FIG. 2. Again stages 1, 2 and 10 constitute a control amplifier providing basically a current I that depends on the desired value represented by reference voltage 3. That current I passes through the load 5 proper and establishes a voltage drop U. That user again is connected to true ground at 8 but that is a true ground and not the ground of the equipment casing. That latter ground is established by 9 and therefore floats in comparison with the true ground 8. The voltage drop 7 across the resistor 4 is the actual voltage that is subject to the control and is fed on one hand to the noninverting input of the differential amplifier 2 while the junction of 4 and 5, meaning voltage U with reference to ground, is fed to the input of a high ohmic impedance changer or converter 6 having unity of amplification.

The impedance converter 6 provides an output which is connected on one hand to the point 9 and on the other hand to the noninverting input of the differential amplifier 2. Thereby serves as reference to the desired and reference voltage 3. This feature then causes the potential in point 9 for a closed loop circuit to a level that is equal to and varies with the voltage U across the load 5 of the user but owing to the impedance converter 6, variations in the load circuit are effective at point 9 only through the impedance converter. Hence, the potential at 9 is floatingly controlled such that the voltage 7 that is effective in the differential stage 2 is not subject to any push push variations in the principal load circuit.

The invention is not limited to the embodiments described above but all changes and modifications thereof, not constituting departures from the spirit and scope of the invention, are intended to be included.

We claim:

1. Circuit for feeding a grounded user with a load independent current there being a series resistor across which a certain voltage representing a desired value that is taken and fed to a control amplifier receiving also a reference voltage as a desired voltage, the improvement comprising a high ohmic impedance converter having its input connected to the load so that its input varies with the voltage across the load and having an output for determining the reference potential for the desired value as it is fed to the control amplifier.

2. Circuit which includes a load connected to ground, a measuring resistor connected in series with the load; a current source feeding current into the load and the resistor, a different amplifier having one output connected to one end of the resistor and having its output connected to a summing point which is an input from the current source, a reference voltage source having one end connected to the summing point, the improvement comprising:

an impedance converter having its input circuit connected to another end of the resistor and its output connected to another input for the differential amplifier, the latter output being further connected to an opposite end of the reference voltage source thus serving as floating ground for the reference source and the differential amplifier.

* * * * *